US007445355B2

(12) United States Patent
Wu

(10) Patent No.: US 7,445,355 B2
(45) Date of Patent: Nov. 4, 2008

(54) MATRIX DISPLAY USING CASSETTE LIGHT UNITS

(76) Inventor: Jiahn-Chang Wu, No. 15, Lane 13, Alley 439, Her-Chiang Street, Chutung, Hsin-Chu (TW) 310

( * ) Notice: Subject to any disclaimer, the term of this patent is extended or adjusted under 35 U.S.C. 154(b) by 229 days.

(21) Appl. No.: 11/458,826

(22) Filed: Jul. 20, 2006

(65) Prior Publication Data

US 2007/0195528 A1 Aug. 23, 2007

(30) Foreign Application Priority Data

Feb. 17, 2006 (TW) ..... 95105301 A

(51) Int. Cl.
*F21V 21/00* (2006.01)

(52) U.S. Cl. ..... 362/249; 362/647; 257/81; 257/99; 257/731

(58) Field of Classification Search ..... 362/249, 362/800, 252, 647; 257/81, 79, 84, 98, 99, 257/433, 434, 704, 723, 731
See application file for complete search history.

(56) References Cited

U.S. PATENT DOCUMENTS

| | | | | |
|---|---|---|---|---|
| 5,617,131 | A * | 4/1997 | Murano et al. | 347/233 |
| 6,583,444 | B2 * | 6/2003 | Fjelstad | 257/82 |
| 6,911,731 | B2 * | 6/2005 | Wu | 257/727 |
| 7,166,868 | B2 * | 1/2007 | Wu | 257/81 |
| 7,297,985 | B2 * | 11/2007 | Oohata et al. | 257/88 |
| 2005/0146028 | A1 * | 7/2005 | Wu | 257/727 |

* cited by examiner

*Primary Examiner*—Thomas M Sember

(57) ABSTRACT

A light board is made with a receptacle substrate for accommodating cassette light units. The convenience of assembly and disassembly of the light units from the receptacle substrate makes the product easily to be maintained for changing different color light units, changing different displaying patterns, removing or replacing a failure light unit.

2 Claims, 9 Drawing Sheets

MATRIX DISPLAY USING CASSETTE LIGHT UNITS

RELATED APPLICATIONS

The present application is based on, and claims priority from, Taiwan Application Serial Number 095105301, filed Feb. 17, 2006, the disclosure of which is hereby incorporated by reference herein in its entirety.

BACKGROUND OF THE INVENTION

1. Field of the Invention

This invention relates to a matrix display of light emitted diodes.

2. Description of the Related Art

FIG. 1 is a prior art that illustrates a traditional light board. Conventional light board is made up with a printed circuit board (PCB) 10 on which a plurality of light-emitting diodes (LED) 11 are positioned. Only one LED 11 is shown in FIG. 1. Each of the diodes has bottom metals 11*a* and 11*b*. Corresponding metal circuits 10*a* and 10*b* is provided on the board 10 to electrically couple with the electrodes 11*a* and 11*b* of the light-emitting diode 11 respectively to form a traditional light-emitting diode display board. The shortcomings of the prior art are as follows: (1) inflexibility in color change, i.e., it is impossible or inconvenient to change different light color diodes at any moment; (2) inconvenience in maintaining and replacing a failure diode.

SUMMARY OF THE INVENTION

The primary object of the present invention is to prepare a light board that is convenient for assembly and disassembly of the light units from the light board. A second object of the present invention is to provide a light board that can be easily maintained and allows for easy changing of different color light units, or different displaying patterns. A third object of the present invention is to provide a light board that allows easy and rapid replacement of a failure light unit from the light board.

In a light board using a cassette light unit, the cassette light unit has a pedestal with a top metal and a bottom metal, and a transparent unit is made at the top of a light chip for modifying the light beam emitted from the light chip. The light board has a first metal coupling with the top metal of the cassette unit when the cassette light unit is inserted in position. A second metal electrically coupling with the bottom metal of the cassette light unit when the cassette light unit is inserted in position. A slit between the first metal and the second metal is for the anchor of the light unit. An insulation material is positioned between the first metal and the second metal for electrical isolation there between.

The cassette light unit comprises: a light-emitting diode chip. The light-emitting diode chip has a first electrode and a second electrode. The top metal of a pedestal electrically couples with the first electrode of the light-emitting diode chip. The bottom metal of a pedestal electrically couples with the second electrode of the light-emitting diode chip. The top metal of the pedestal has an open area to accommodate the light-emitting diode chip to be mounted onto the bottom metal. An insulation material is positioned between the top metal and the bottom metal for electrical insulation there between. A transparent head is positioned above the light-emitting diode chip for modifying the light beam emitted from the light chip.

The present invention discloses a light board having openings on a plurality of coplanar first metals for the insertion of the light units. It is convenient to change different color light units, and it is easy and rapid to remove or replace a failure light unit from the light board.

DETAILED DESCRIPTION OF THE PREFERRED EMBODIMENTS

Figure 1:
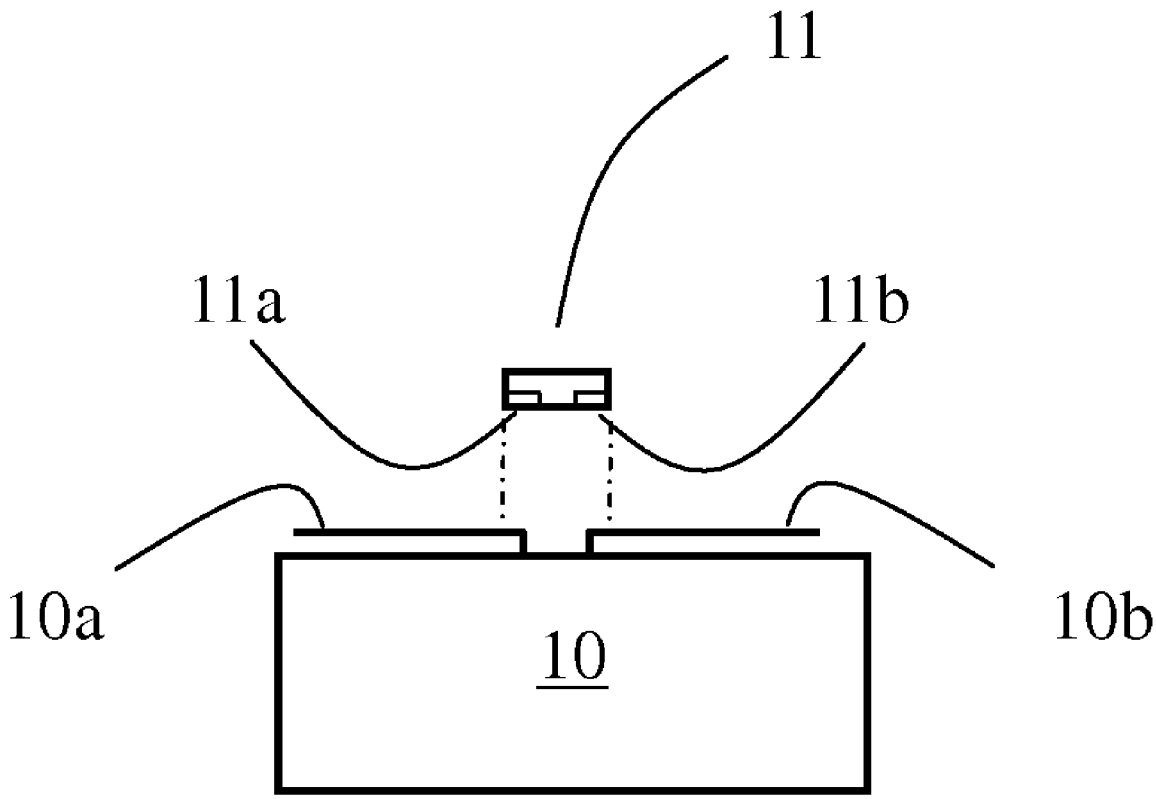
Fig. 1. Prior Art
FIG. 1 is a traditional light board.

FIG. 2A is a top view of a light unit 50 used in this invention. It shows a cassette light unit 50 that encapsulates a light-emitting diode chip 20. The light unit 50 has pedestal with a top metal 21 and a bottom metal 22. The first electrode or surface electrode of the light-emitting diode chip 20 is electrically coupled with the top metal 21 through a bonding wire 24. The top metal 21 has an open area at its center for mounting light-emitting diode chip 20 on the top surface of bottom metal 22. The second electrode or bottom electrode of the light-emitting diode chip 20 is electrically coupled with the bottom metal 22. A transparent glue 23 is coated above the light-emitting diode chip 20 for modifying the emitted light and to ensure the reliability of the product. Double wire bonding can be used to couple the two electrodes respectively to the top metal 21 and the bottom metal 22 if the LED 20 has two surface electrodes.

FIG. 2B is a side view of the light unit 50 of FIG. 2A. It shows a cassette light unit 50 comprises: a light-emitting diode chip 20 mounted on the top surface of the bottom metal 22 through an open area of the top metal 21. The top metal 21 is electrically coupled with the first electrode or surface electrode of the light-emitting diode chip 20 through a metal wire 24. The bottom metal 22 is electrically coupled with the second electrode or bottom electrode of the light-emitting diode chip 20. A transparent glue 23 is made above the light-emitting chip 20 to modify the emitted light. An insulation material 25 is positioned in between the top metal 21 and the bottom metal 22 for electricity insulation there between.

Figure 3:
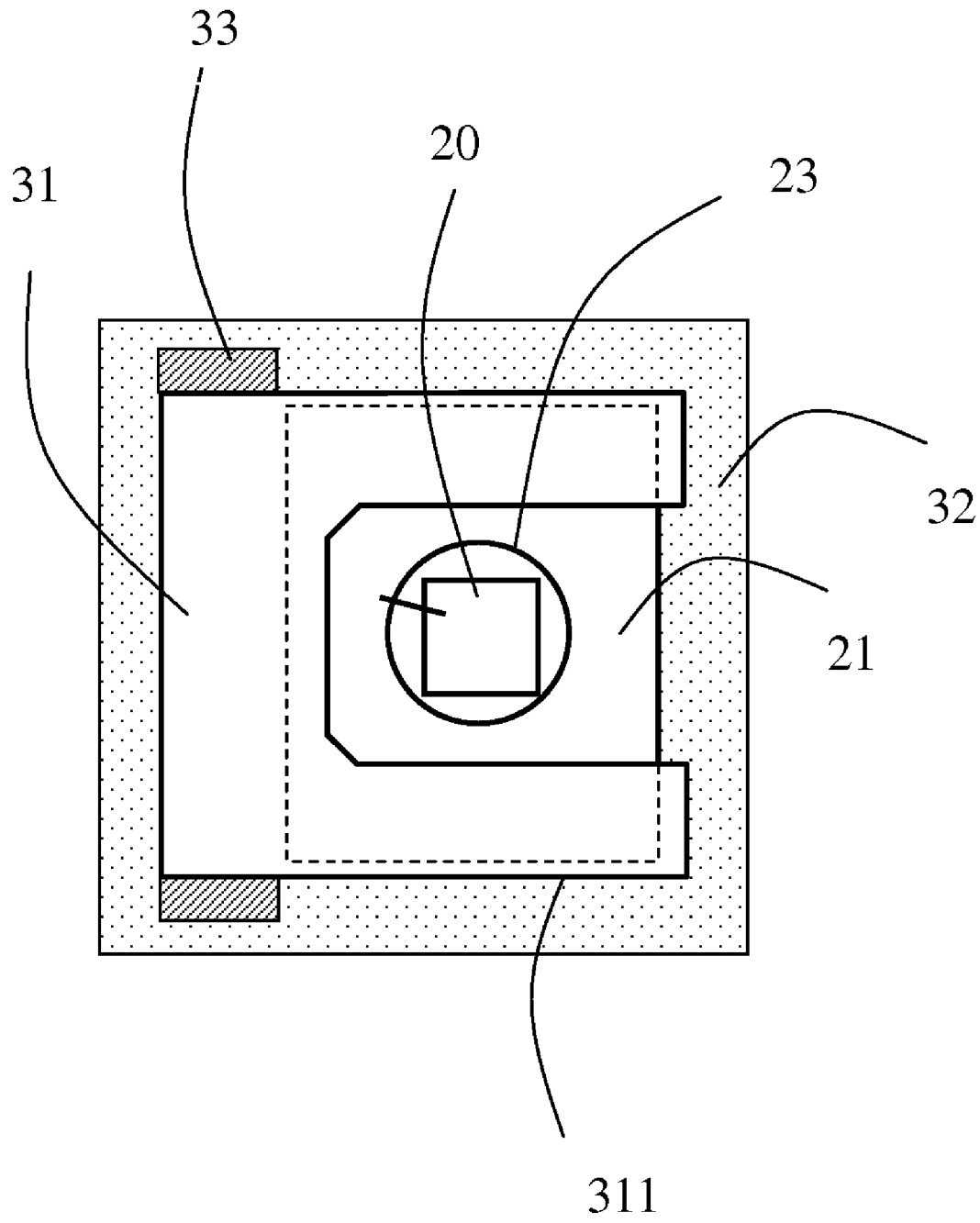
FIG. 3 is a top view of a first embodiment of the present invention with a single light unit.

FIG. 3 is a top view of a first embodiment of the present invention with a single light unit 50. A light board with a single cassette light unit 50 of the present invention is shown. A receptacle substrate of the light board has a first metal 31 and a second metal 32. The first metal 31 has a pair of elastic cantilevers 311 which hold the periphery of the top metal 21 of the pedestal of the cassette light unit 50 steadily, so as to anchor the cassette light unit 50 in position. Each elastic cantilever 311 is electrically coupled with the top metal 21 of the cassette light unit 50. The open area between the parallel elastic cantilevers 311 allows for light emission of the cassette light unit 50. An insulation material 33 is disposed between the first metal 31 and the second metal 32.

Figure 4:
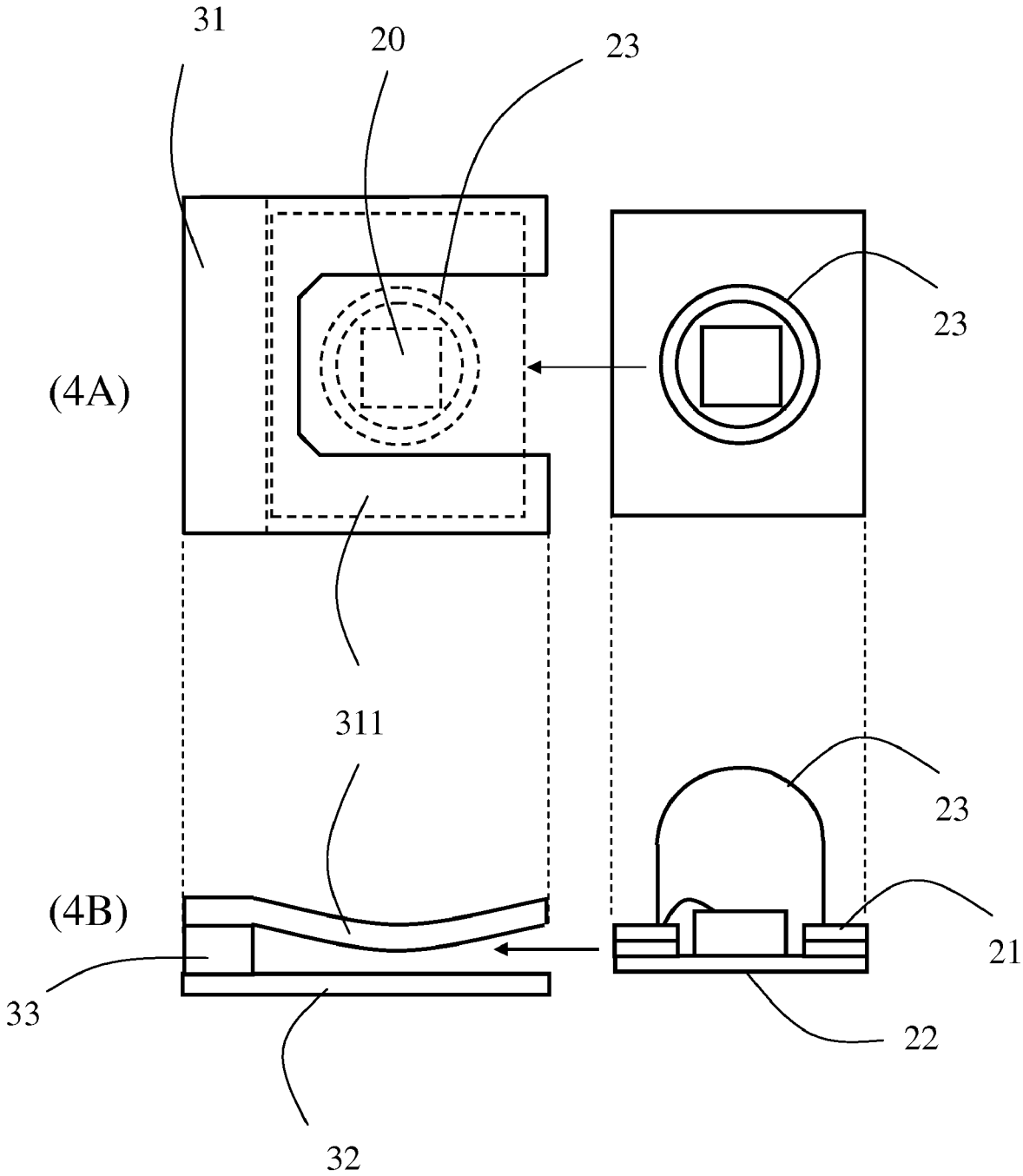
FIG. 4A is a top view of a light board of the present invention before insertion of a light unit.
FIG. 4B is a side view of FIG. 4A.

FIG. 4A is a top view of a light board of the present invention before insertion of a light unit 50. The first metal 31 has a parallel elastic cantilevers 311. A light unit 50 is inserted in between the first metal 31 and the second metal 32. The dotted lines denote an inserted light unit 50. The transparent glue 23 is protruded out above the first metal 31 for handling. The transparent glue 23 can be made thin for reliability only.

FIG. 4B is a side view of FIG. 4A. A cassette light unit 50 is shown ready to be inserted into a slot of the receptacle substrate. It shows that the receptacle substrate has a first metal 31 and a second metal 32, and an insulating material 33 disposed in between the first metal 31 and the second metal 32. The first metal 31 has a pair of parallel elastic cantilever 311 for touching and anchoring the inserted cassette light unit 50. Each elastic cantilever 311 is electrically coupled with the top metal 21 of the cassette light unit 50 and the second metal 32 is electrically coupled with the bottom metal 22 of the cassette light unit 50 when the cassette light unit 50 is inserted in position. Due to the small size of the cassette light unit 50, the protruded transparent head 23 can be made bigger as a grip for handling for assembly and disassembly of the light unit 50. The transparent glue 23 can be alternatively made very thin for light emission modification or for reliability only.

Figure 5:
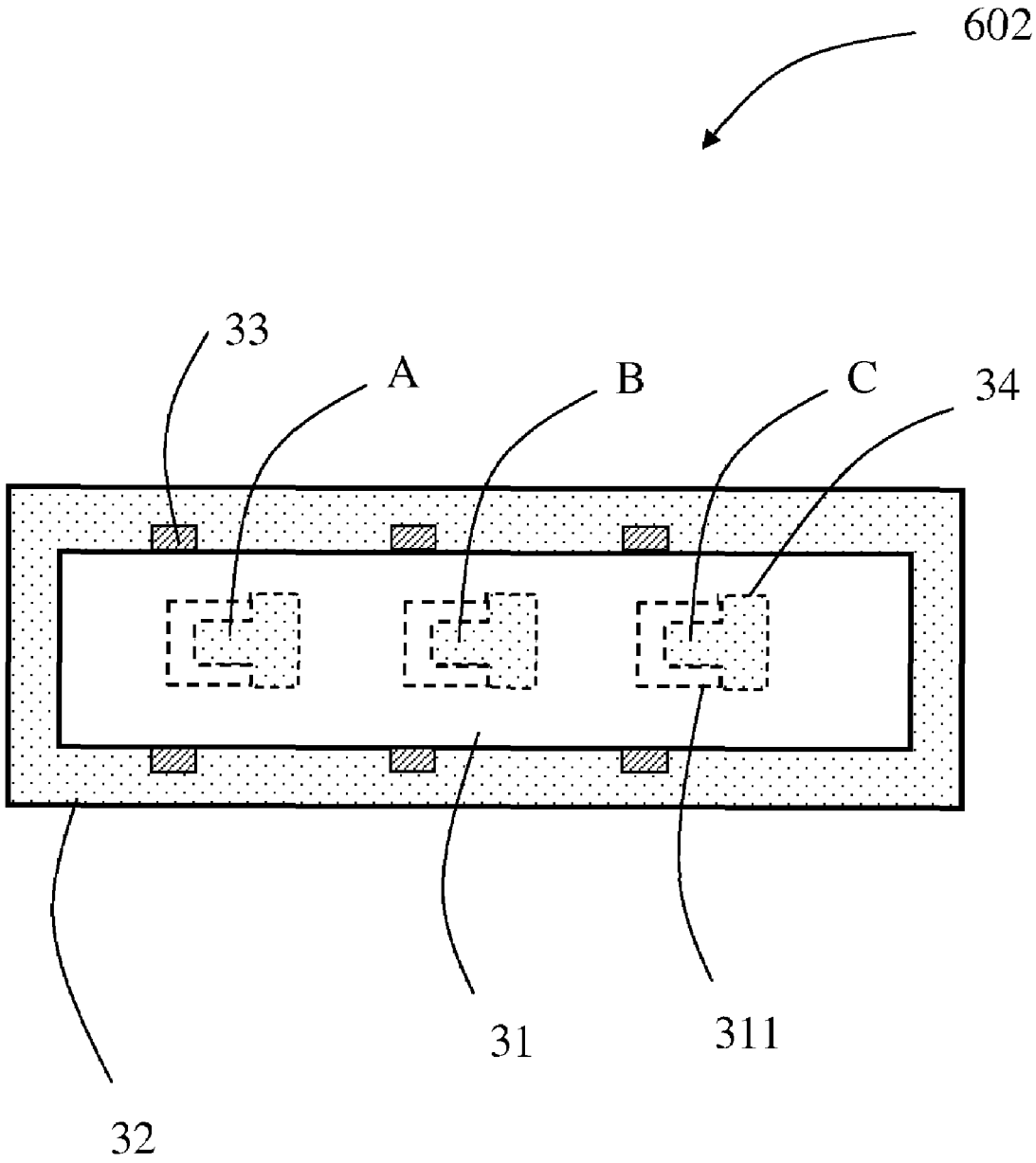
FIG. 5 is a top view of a light board of the present invention with multiple light unit slots.

FIG. 5 is a top view of a light board of the present invention with multiple light unit slots arranged in a row, i.e., in a line-type. An elongated light board receptacle substrate 602 is shown to include a first metal 31, a second metal 32, and insulation layer 33 inserted between the first metal 31 and the second metal 32. Parallel cantilevers 311 are elastically bent downward, toward the second metal 32. The open area between each pair of parallel cantilevers 311 is for accommodation of one light unit 50.

Figure 6:
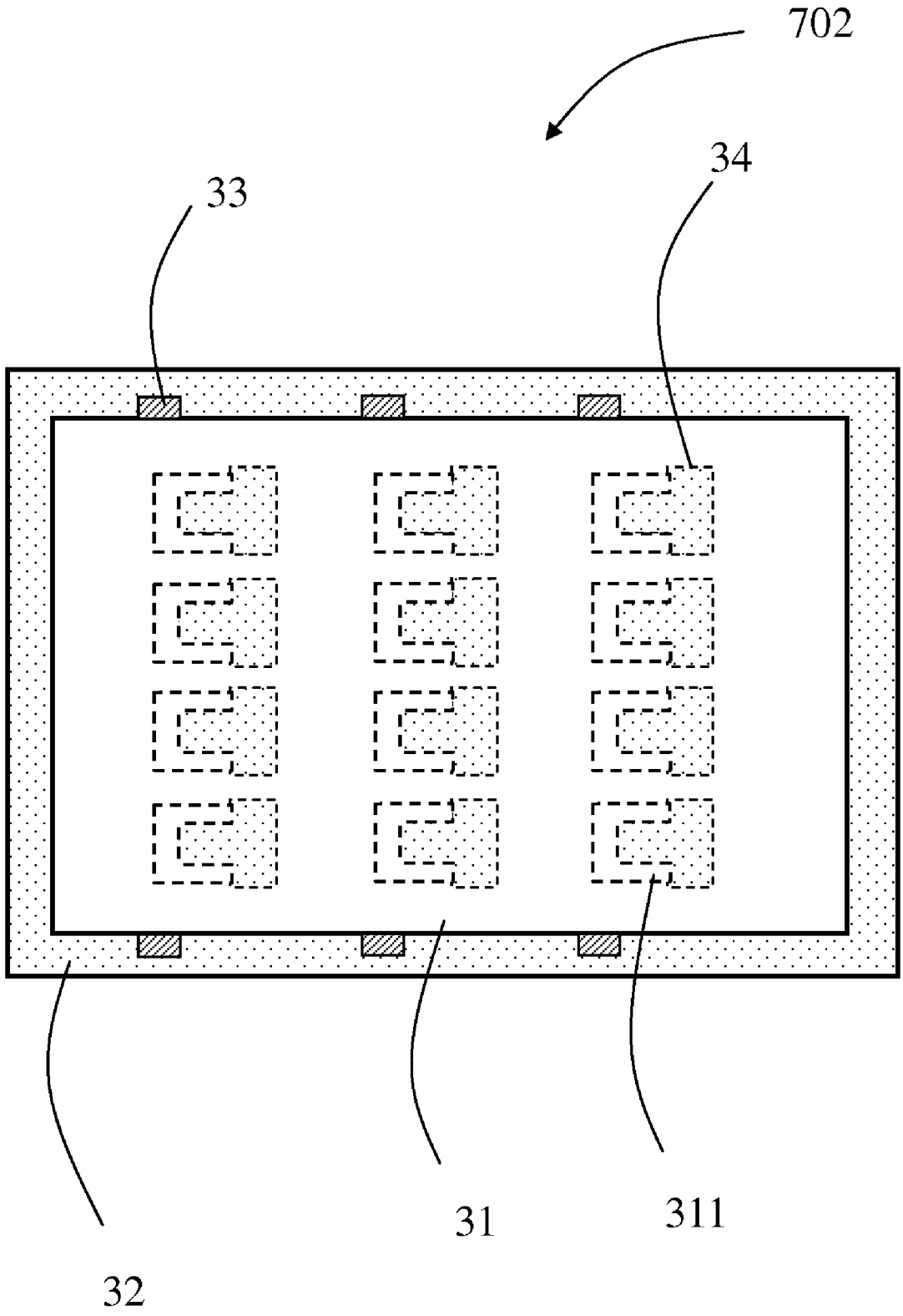
FIG. 6 is a top view of a second embodiment of the present invention with a matrix light unit slots.

FIG. 6 is a top view of a second embodiment of the present invention with matrix light unit slots. A matrix light board is illustrated as having, e.g., 4*3 receptacle slots, each slot is ready to receive a cassette light unit 50 (not shown in this figure).

The transparent glue 23 can be in the shape of a lamp bulb, so as to modify the emitted light. The transparent bead 23 can be alternatively made into different products, such as, animals, plants, people, mountain or river sceneries, knives or forks and buildings etc. The product shall emit the light from the embedded light chip when the light unit is inserted into the receptacle in position, and become a lighting sculpture product.

Figure 7:
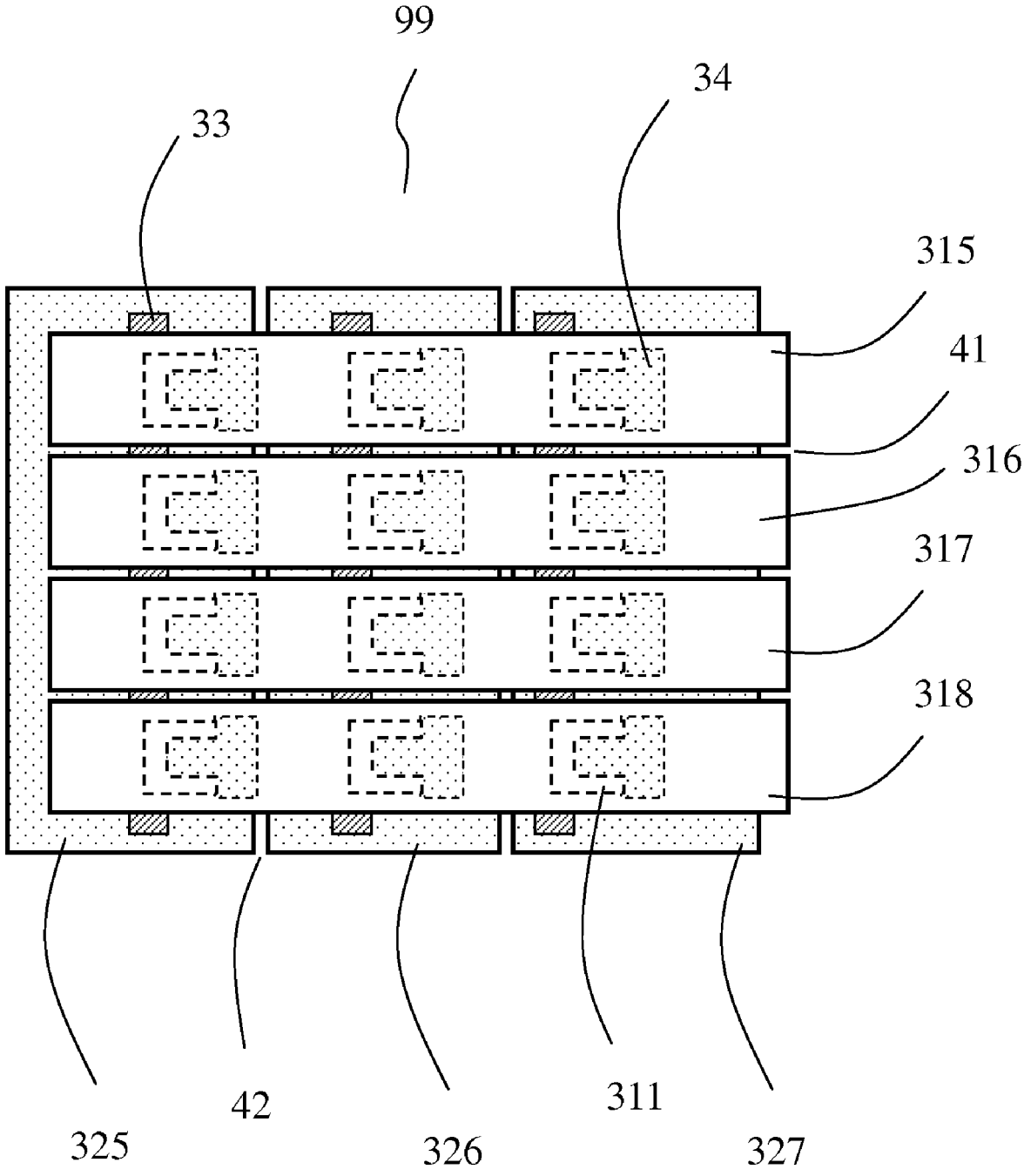
FIG. 7 is a plane view of a matrix display according to the present invention

FIG. 7 is a plane view of a matrix display according to the present invention.

Figure 2:
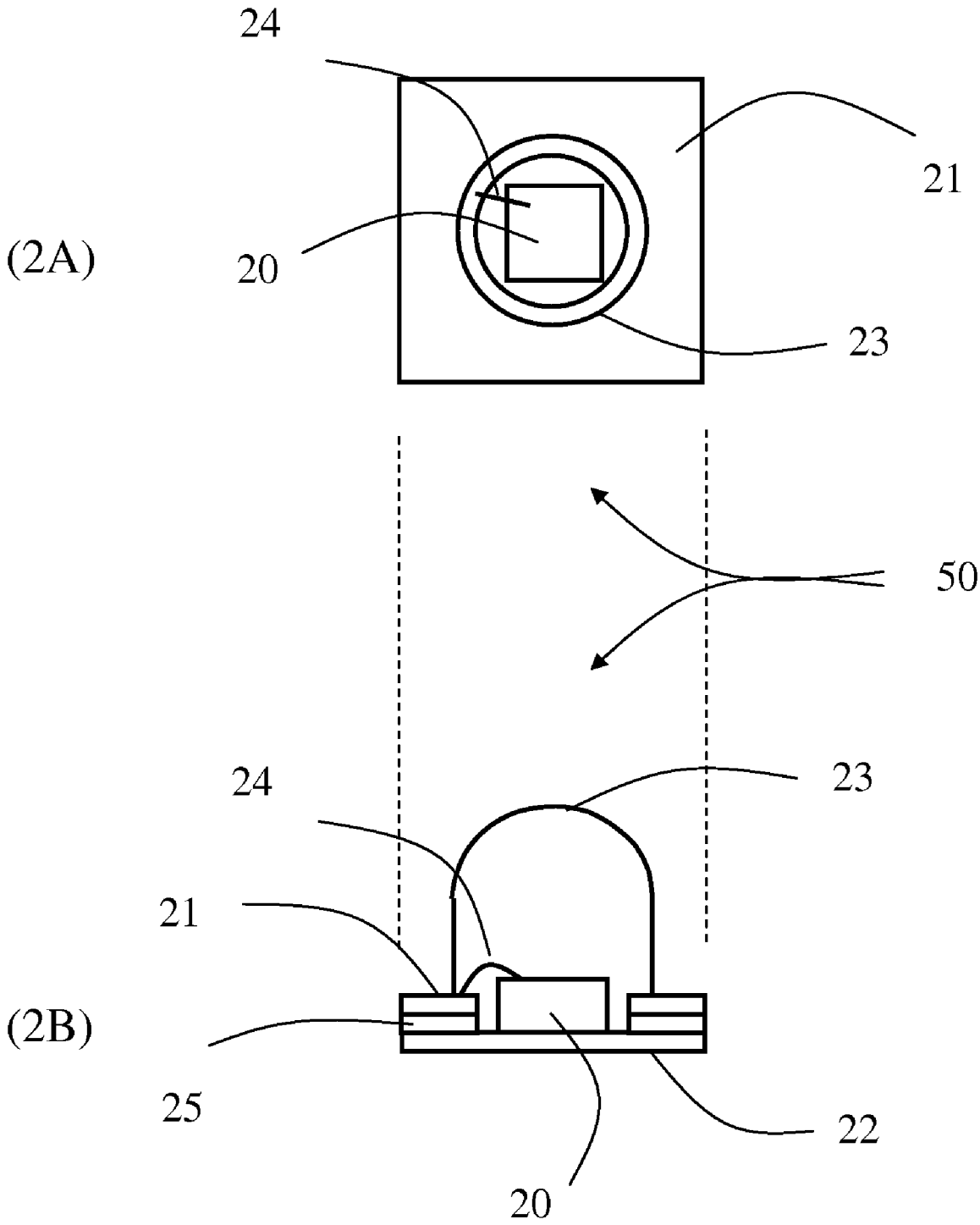
FIG. 2A is a top view of a cassette light unit used in the present invention.
FIG. 2B is a side view of FIG. 2A.

A matrix display 99 made of 4*3 light units is shown as an example. Four coplanar parallel first metals (315~318) are interweaved with three coplanar parallel second metals (325~327); each of the first metals (315~318) has three sockets with parallel cantilevers 311 and an opening 34, the opening 34 is for the insertion of a light unit 50 as shown in FIG. 2. Insulation slits 41 are set for the insulation between the first metals 315~318. Through each opening 34, a corresponding one of second metals 325~327 is exposed. Insulation material 33 is disposed between the first metals 315~318 and the second metals 325~327 for electric insulation. Insulation slits 42 are set for the insulation between the parallel second metals. Insulation slits 41, 42 are, e.g., air gaps, however, it can be made by other well-known insulation materials.

Once a light unit is inserted in position, the top metal 21 of the pedestal electrically couples to the corresponding first metal 315~318, the bottom metal 22 of the pedestal electrically couples to the corresponding second metal 325~327. The first metals 315~318 and the second metals 325~327 are each connected to a control circuit (not shown) so as to control the on/off of each of the light units to form a matrix display.

Figure 8:
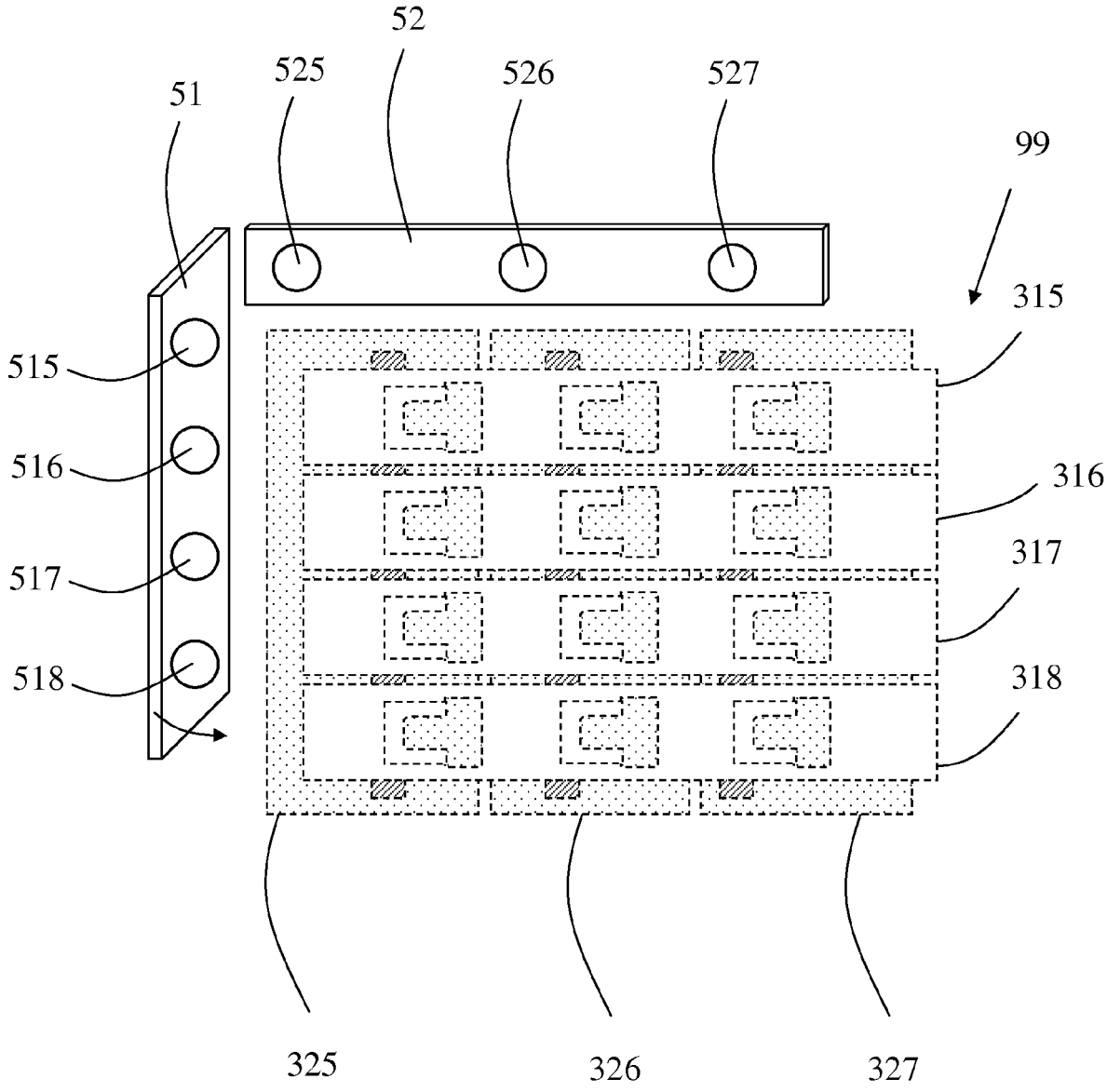
FIG. 8 is a first frame used in the present invention.

FIG. 8 is a frame used in the present invention

A frame to anchor the matrix display 99 is disclosed. A horizontal bar 52 has three metal contacts 525~527. When the horizontal bar 52 is attached to the display 99 from rear, the first ends of the three metal contacts couple electrically to the corresponding second metals 325~327. The second ends of the three metal contacts 525~527 couple to a first power terminal (not shown in the figure). Similarly, a vertical frame bar 51 has four metal contacts 515~518. When the vertical bar 51 flips to attach to the display 99, the four metal contacts couple electrically to the corresponding first metals 315~318. The second ends of the four metal contacts 515~518 couple to a second power terminal (not shown in the figure).

Figure 9:
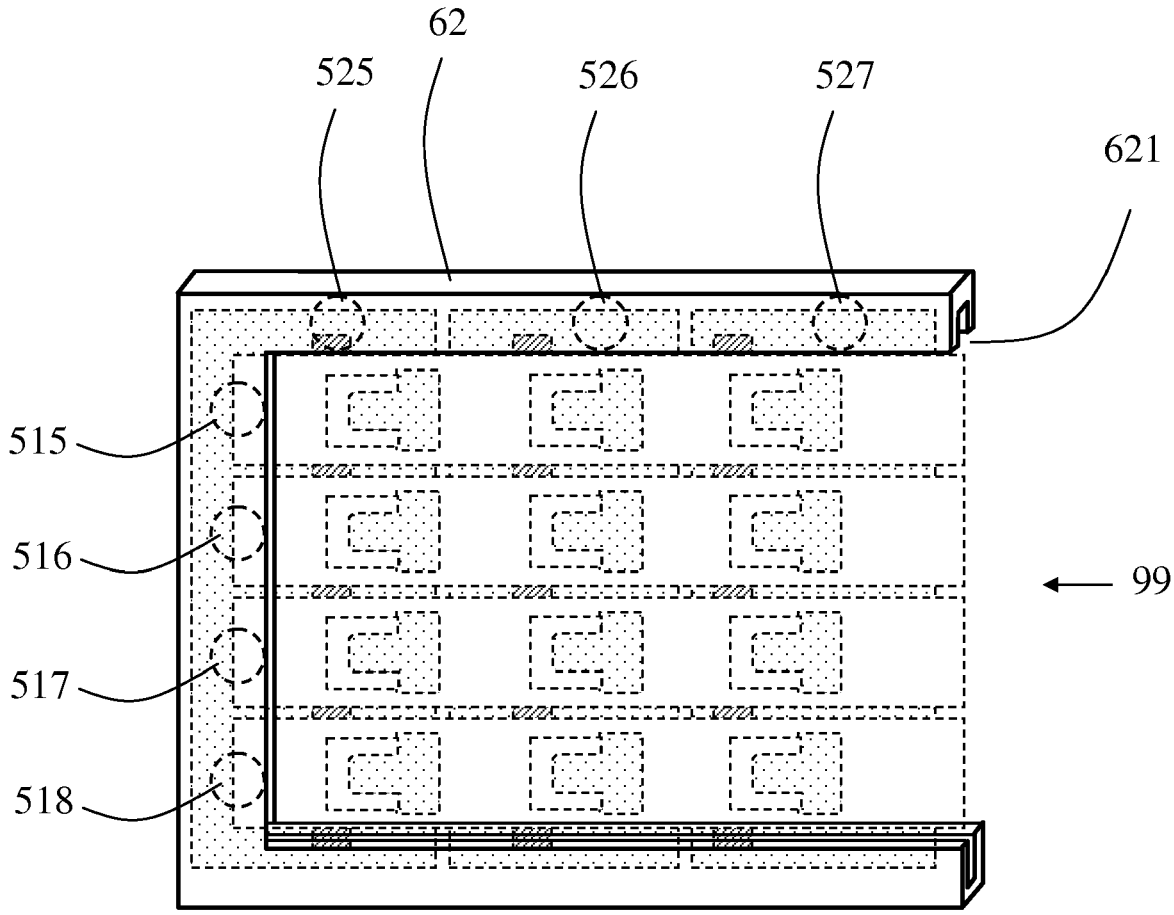
FIG. 9 is a second frame used in the present invention.

FIG. 9 is a second frame used in the present invention

The frame is a second design for the matrix display of this invention. FIG. 9 is a frame that is an integral structure of the prior design shown in FIG. 8. A U shaped frame 62 has one side opening for the sliding in/out of a matrix display 99. The opening side can be either in the left side, right side, topside, or bottom side for the sliding in/out of the display 99. A right side opening is shown as an example in FIG. 9. The U shaped frame 62 has a groove 621 made in its three sides designed for the insertion and retention of the matrix display 99. There are three metal contacts 525~527 in the horizontal section of the frame 62 each of which electrically couples to a corresponding one of the three vertical metals 325~327. There are four metal contacts 515~518 in the vertical section of the frame 62 each of which electrically couples to a corresponding one of the four horizontal metals 315~318. The metal contacts 525~527 and 515~518 electrically couple to a power supply (not shown) for the controlling on/off of each light unit in the matrix display 99.

While the preferred embodiments has been described by way of example, it will be apparent to those skilled in the art that various modification may be made in the embodiments without departing from the spirit of the present invention. Such modifications are all within the scope of the present invention, as defined by the appended claims.

What is claimed is:

1. A matrix display, comprising:

a plurality of light units, each having a pedestal with a top metal and a bottom metal;

a plurality of coplanar first metals, each having openings for allowing light transmission from said light units and being coupled to said top metals of said light units;

a plurality of coplanar second metals electrically coupled to said bottom metals of said light units; and a frame having a plurality metal contacts each with a first end being electrically coupled to a corresponding one of said first or second metal, and with a second end for coupling to power.

2. The matrix display as claimed in claim 1, further comprising:

a groove formed in the frame, for allowing sliding movement of the matrix display in and out of said frame.

* * * * *